US011878206B2

(12) United States Patent
Dalebout et al.

(10) Patent No.: US 11,878,206 B2
(45) Date of Patent: Jan. 23, 2024

(54) STRENGTH TRAINING APPARATUS

(71) Applicant: iFIT Inc., Logan, UT (US)

(72) Inventors: William Dalebout, Logan, UT (US); Michael Olson, Logan, UT (US)

(73) Assignee: iFIT Inc., Logan, UT (US)

( * ) Notice: Subject to any disclaimer, the term of this patent is extended or adjusted under 35 U.S.C. 154(b) by 85 days.

(21) Appl. No.: 17/727,575

(22) Filed: Apr. 22, 2022

(65) Prior Publication Data

US 2022/0266085 A1 Aug. 25, 2022

Related U.S. Application Data

(60) Division of application No. 16/923,275, filed on Jul. 8, 2020, now Pat. No. 11,338,169, which is a (Continued)

(51) Int. Cl.
*A63B 21/22* (2006.01)
*A63B 21/00* (2006.01)
(Continued)

(52) U.S. Cl.
CPC ..... *A63B 21/225* (2013.01); *A63B 21/005* (2013.01); *A63B 21/0051* (2013.01);
(Continued)

(58) Field of Classification Search
CPC ..... A63B 21/225; A63B 24/0087; A63B 24/0062; A63B 21/151; A63B 21/4047; A63B 21/005; A63B 23/03525; A63B 21/0051; A63B 21/00192; A63B 23/12; A63B 21/4035; A63B 21/4043; A63B 21/4049; A63B 23/1227; A63B 23/1218; A63B 23/1209; A63B 23/03541; A63B 23/03533; A63B 21/156; A63B 21/154; A63B 21/0442; A63B 21/0052;
(Continued)

(56) References Cited

U.S. PATENT DOCUMENTS 3,123,646 A 3/1964 Faston
3,579,339 A 5/1971 Chang et al.
(Continued)

OTHER PUBLICATIONS

U.S. Appl. No. 63/316,890.

*Primary Examiner* — Andrew S Lo
(74) *Attorney, Agent, or Firm* — Ray Quinney & Nebeker P.C.; Paul N. Taylor

(57) ABSTRACT

Embodiments of a strength training apparatus and related methods are provided. In one embodiment, a strength training apparatus may include a tower, a first arm and a second arm each pivotally coupled with the tower and each being configured to be selectively positionable independent of each other at multiple angles relative to each other, a first pulley coupled to an end of the first arm, a first cable extending through the first arm and the first pulley, a second pulley coupled to an end of the second arm, a second cable extending through the second arm and the second pulley, a magnetic mechanism coupled to the first cable and the second cable and configured to provide multiple levels of resistance to a user pulling on the first cable and/or the second cable, and a control panel located on the tower.

20 Claims, 7 Drawing Sheets

Related U.S. Application Data continuation of application No. 16/404,413, filed on May 6, 2019, now Pat. No. 10,709,925, which is a continuation of application No. 15/472,954, filed on Mar. 29, 2017, now Pat. No. 10,279,212, which is a continuation of application No. 15/019,088, filed on Feb. 9, 2016, now Pat. No. 9,616,276, which is a continuation of application No. 14/213,793, filed on Mar. 14, 2014, now Pat. No. 9,254,409.

(60) Provisional application No. 61/786,007, filed on Mar. 14, 2013.

(51) Int. Cl.

| | |
|---|---|
| ***A63B 21/005*** | (2006.01) |
| ***A63B 21/04*** | (2006.01) |
| ***A63B 23/035*** | (2006.01) |
| ***A63B 23/12*** | (2006.01) |
| ***A63B 24/00*** | (2006.01) |
| ***A63B 71/06*** | (2006.01) |

(52) U.S. Cl.

CPC .... *A63B 21/0052* (2013.01); *A63B 21/00076* (2013.01); *A63B 21/00192* (2013.01); *A63B 21/0442* (2013.01); *A63B 21/151* (2013.01); *A63B 21/154* (2013.01); *A63B 21/156* (2013.01); *A63B 21/4035* (2015.10); *A63B 21/4043* (2015.10); *A63B 21/4047* (2015.10); *A63B 21/4049* (2015.10); *A63B 23/03525* (2013.01); *A63B 23/03533* (2013.01); *A63B 23/03541* (2013.01); *A63B 23/12* (2013.01); *A63B 23/1209* (2013.01); *A63B 23/1218* (2013.01); *A63B 23/1227* (2013.01); *A63B 24/0062* (2013.01); *A63B 24/0087* (2013.01); *A63B 21/0056* (2013.01); *A63B 2024/0065* (2013.01); *A63B 2024/0093* (2013.01); *A63B 2071/0625* (2013.01); *A63B 2071/0675* (2013.01); *A63B 2071/0694* (2013.01); *A63B 2220/54* (2013.01); *A63B 2220/833* (2013.01); *A63B 2225/09* (2013.01)

(58) Field of Classification Search

CPC ..... A63B 21/00076; A63B 21/0056; A63B 2071/0625; A63B 2024/0093; A63B 2225/09; A63B 2220/833; A63B 2220/54; A63B 2071/0694; A63B 2071/0675; A63B 2024/0065

See application file for complete search history.

(56) References Cited

U.S. PATENT DOCUMENTS

| | | | |
|---|---|---|---|
| 4,023,795 | A | 5/1977 | Pauls |
| 4,300,760 | A | 11/1981 | Bobroff |
| D286,311 | S | 10/1986 | Martinell et al. |
| 4,681,318 | A | 7/1987 | Lay |
| 4,684,126 | A | 8/1987 | Dalebout et al. |
| 4,728,102 | A | 3/1988 | Pauls |
| 4,750,736 | A | 6/1988 | Watterson |
| 4,796,881 | A | 1/1989 | Watterson |
| 4,813,667 | A | 3/1989 | Watterson |
| 4,844,451 | A | 7/1989 | Bersonnet et al. |
| 4,850,585 | A | 7/1989 | Dalebout |
| D304,849 | S | 11/1989 | Watterson |
| 4,880,225 | A | 11/1989 | Lucas et al. |
| 4,883,272 | A | 11/1989 | Lay |
| D306,468 | S | 3/1990 | Watterson |
| D306,891 | S | 3/1990 | Watterson |
| 4,913,396 | A | 4/1990 | Dalebout et al. |
| D307,614 | S | 5/1990 | Bingham et al. |
| D307,615 | S | 5/1990 | Bingham et al. |
| 4,921,242 | A | 5/1990 | Watterson |
| 4,932,650 | A | 6/1990 | Bingham et al. |
| D309,167 | S | 7/1990 | Griffin |
| D309,485 | S | 7/1990 | Bingham et al. |
| 4,938,478 | A | 7/1990 | Lay |
| D310,253 | S | 8/1990 | Bersonnet et al. |
| 4,955,599 | A | 9/1990 | Bersonnet et al. |
| 4,971,316 | A | 11/1990 | Dalebout et al. |
| D313,055 | S | 12/1990 | Watterson |
| 4,974,832 | A | 12/1990 | Dalebout |
| 4,979,737 | A | 12/1990 | Kock |
| 4,981,294 | A | 1/1991 | Dalebout et al. |
| D315,765 | S | 3/1991 | Measom et al. |
| 4,998,725 | A | 3/1991 | Watterson et al. |
| 5,000,442 | A | 3/1991 | Dalebout et al. |
| 5,000,443 | A | 3/1991 | Dalebout et al. |
| 5,000,444 | A | 3/1991 | Dalebout et al. |
| D316,124 | S | 4/1991 | Dalebout et al. |
| 5,013,033 | A | 5/1991 | Watterson et al. |
| 5,014,980 | A | 5/1991 | Bersonnet et al. |
| 5,016,871 | A | 5/1991 | Dalebout et al. |
| D318,085 | S | 7/1991 | Jacobson et al. |
| D318,086 | S | 7/1991 | Bingham et al. |
| D318,699 | S | 7/1991 | Jacobson et al. |
| 5,029,801 | A | 7/1991 | Dalebout et al. |
| 5,034,576 | A | 7/1991 | Dalebout et al. |
| 5,058,881 | A | 10/1991 | Measom |
| 5,058,882 | A | 10/1991 | Dalebout et al. |
| D321,388 | S | 11/1991 | Dalebout |
| 5,062,626 | A | 11/1991 | Dalebout et al. |
| 5,062,627 | A | 11/1991 | Bingham |
| 5,062,632 | A | 11/1991 | Dalebout et al. |
| 5,062,633 | A | 11/1991 | Engel et al. |
| 5,067,710 | A | 11/1991 | Watterson et al. |
| 5,072,929 | A | 12/1991 | Peterson et al. |
| D323,009 | S | 1/1992 | Dalebout et al. |
| D323,198 | S | 1/1992 | Dalebout et al. |
| D323,199 | S | 1/1992 | Dalebout et al. |
| D323,863 | S | 2/1992 | Watterson |
| 5,088,729 | A | 2/1992 | Dalebout |
| 5,090,694 | A | 2/1992 | Pauls et al. |
| 5,102,380 | A | 4/1992 | Jacobson et al. |
| 5,104,120 | A | 4/1992 | Watterson et al. |
| 5,108,093 | A | 4/1992 | Watterson |
| D326,491 | S | 5/1992 | Dalebout |
| 5,122,105 | A | 6/1992 | Engel et al. |
| 5,135,216 | A | 8/1992 | Bingham et al. |
| 5,147,265 | A | 9/1992 | Pauls et al. |
| 5,149,084 | A | 9/1992 | Dalebout et al. |
| 5,149,312 | A | 9/1992 | Croft et al. |
| 5,171,196 | A | 12/1992 | Lynch |
| D332,347 | S | 1/1993 | Raadt et al. |
| 5,190,505 | A | 3/1993 | Dalebout et al. |
| 5,192,255 | A | 3/1993 | Dalebout et al. |
| 5,195,937 | A | 3/1993 | Engel et al. |
| 5,203,826 | A | 4/1993 | Dalebout |
| D335,511 | S | 5/1993 | Engel et al. |
| D335,905 | S | 5/1993 | Cutter et al. |
| D336,498 | S | 6/1993 | Engel et al. |
| 5,217,487 | A | 6/1993 | Engel et al. |
| D337,361 | S | 7/1993 | Engel et al. |
| D337,666 | S | 7/1993 | Peterson et al. |
| D337,799 | S | 7/1993 | Cutter et al. |
| 5,226,866 | A | 7/1993 | Engel et al. |
| 5,244,446 | A | 9/1993 | Engel et al. |
| 5,247,853 | A | 9/1993 | Dalebout |
| 5,259,611 | A | 11/1993 | Dalebout et al. |
| D342,106 | S | 12/1993 | Campbell et al. |
| 5,279,528 | A | 1/1994 | Dalebout et al. |
| D344,112 | S | 2/1994 | Smith |
| D344,557 | S | 2/1994 | Ashby |
| 5,282,776 | A | 2/1994 | Dalebout |
| 5,295,931 | A | 3/1994 | Dreibelbis et al. |
| 5,302,161 | A | 4/1994 | Loubert et al. |
| D347,251 | S | 5/1994 | Dreibelbis et al. |
| 5,316,534 | A | 5/1994 | Dalebout et al. |
| D348,493 | S | 7/1994 | Ashby |
| D348,494 | S | 7/1994 | Ashby |

(56) References Cited

U.S. PATENT DOCUMENTS 5,328,164 A 7/1994 Soga
D349,931 S 8/1994 Bostic et al.
5,336,142 A 8/1994 Dalebout et al.
5,344,376 A 9/1994 Bostic et al.
D351,202 S 10/1994 Bingham
D351,435 S 10/1994 Peterson et al.
D351,633 S 10/1994 Bingham
D352,534 S 11/1994 Dreibelbis et al.
D353,422 S 12/1994 Bostic et al.
5,372,559 A 12/1994 Dalebout et al.
5,374,228 A 12/1994 Buisman et al.
5,382,221 A 1/1995 Hsu et al.
5,387,168 A 2/1995 Bostic
5,393,690 A 2/1995 Fu et al.
D356,128 S 3/1995 Smith et al.
5,409,435 A 4/1995 Daniels
5,429,563 A 7/1995 Engel et al.
5,431,612 A 7/1995 Holden
D360,915 S 8/1995 Bostic et al.
5,468,205 A 11/1995 McFall et al.
5,489,249 A 2/1996 Brewer et al.
5,492,517 A 2/1996 Bostic et al.
D367,689 S 3/1996 Wilkinson et al.
5,511,740 A 4/1996 Loubert et al.
5,512,025 A 4/1996 Dalebout et al.
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout et al.
5,549,533 A 8/1996 Olson et al.
5,554,085 A 9/1996 Dalebout
5,569,128 A 10/1996 Dalebout
5,591,105 A 1/1997 Dalebout et al.
5,591,106 A 1/1997 Dalebout et al.
5,595,556 A 1/1997 Dalebout et al.
5,607,375 A 3/1997 Dalebout et al.
5,611,539 A 3/1997 Watterson et al.
5,622,527 A 4/1997 Watterson et al.
5,626,538 A 5/1997 Dalebout et al.
5,626,542 A 5/1997 Dalebout et al.
D380,024 S 6/1997 Novak et al.
5,637,059 A 6/1997 Dalebout
D380,509 S 7/1997 Wilkinson et al.
5,643,153 A 7/1997 Nylen et al.
5,645,509 A 7/1997 Brewer et al.
D384,118 S 9/1997 Deblauw
5,662,557 A 9/1997 Watterson et al.
5,669,857 A 9/1997 Watterson et al.
5,672,140 A 9/1997 Watterson et al.
5,674,156 A 10/1997 Watterson et al.
5,674,453 A 10/1997 Watterson et al.
5,676,624 A 10/1997 Watterson et al.
5,683,331 A 11/1997 Dalebout
5,683,332 A 11/1997 Watterson et al.
D387,825 S 12/1997 Fleck et al.
5,695,433 A 12/1997 Buisman
5,695,434 A 12/1997 Dalebout et al.
5,695,435 A 12/1997 Dalebout et al.
5,702,325 A 12/1997 Watterson et al.
5,704,879 A 1/1998 Watterson et al.
5,718,657 A 2/1998 Dalebout et al.
5,720,200 A 2/1998 Anderson et al.
5,720,698 A 2/1998 Dalebout et al.
D392,006 S 3/1998 Dalebout et al.
5,722,922 A 3/1998 Watterson et al.
5,733,229 A 3/1998 Dalebout et al.
5,743,833 A 4/1998 Watterson et al.
5,762,584 A 6/1998 Daniels
5,762,587 A 6/1998 Dalebout et al.
5,772,560 A 6/1998 Watterson et al.
5,810,698 A 9/1998 Hullett et al.
5,827,155 A 10/1998 Jensen et al.
5,830,114 A 11/1998 Halfen et al.
5,860,893 A 1/1999 Watterson et al.
5,860,894 A 1/1999 Dalebout et al.
5,899,834 A 5/1999 Dalebout et al.
D412,953 S 8/1999 Armstrong
D413,948 S 9/1999 Dalebout
5,951,441 A 9/1999 Dalebout et al.
5,951,448 A 9/1999 Bolland
D416,596 S 11/1999 Armstrong
6,003,166 A 12/1999 Hald et al.
6,019,710 A 2/2000 Dalebout et al.
6,027,429 A 2/2000 Daniels
6,033,347 A 3/2000 Dalebout et al.
D425,940 S 5/2000 Halfen et al.
6,059,692 A 5/2000 Hickman
D428,949 S 8/2000 Simonson
6,123,646 A 9/2000 Colassi
6,171,217 B1 1/2001 Cutler
6,171,219 B1 1/2001 Simonson
6,174,267 B1 1/2001 Dalebout
6,193,631 B1 2/2001 Hickman
6,228,003 B1 5/2001 Hald et al.
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout et al.
6,312,363 B1 11/2001 Watterson et al.
D452,338 S 12/2001 Dalebout et al.
D453,543 S 2/2002 Cutler
D453,948 S 2/2002 Cutler
6,350,218 B1 2/2002 Dalebout et al.
6,387,020 B1 5/2002 Simonson
6,413,191 B1 7/2002 Harris et al.
6,422,980 B1 7/2002 Simonson
6,447,424 B1 9/2002 Ashby et al.
6,458,060 B1 10/2002 Watterson et al.
6,458,061 B2 10/2002 Simonson
6,471,622 B1 10/2002 Hammer et al.
6,563,225 B2 5/2003 Soga et al.
6,601,016 B1 7/2003 Brown et al.
6,623,140 B2 9/2003 Watterson
6,626,799 B2 9/2003 Watterson
6,652,424 B2 11/2003 Dalebout
6,685,607 B1 2/2004 Olson
6,695,581 B2 2/2004 Wasson et al.
6,701,271 B2 3/2004 Willner et al.
6,702,719 B1 3/2004 Brown et al.
6,712,740 B2 3/2004 Simonson
6,730,002 B2 5/2004 Hald et al.
6,743,153 B2 6/2004 Watterson et al.
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson et al.
6,808,472 B1 10/2004 Hickman
6,821,230 B2 11/2004 Dalebout et al.
6,830,540 B2 12/2004 Watterson et al.
6,863,641 B1 3/2005 Brown et al.
6,866,613 B1 3/2005 Brown et al.
6,875,160 B2 4/2005 Watterson et al.
D507,311 S 7/2005 Butler et al.
6,918,858 B2 7/2005 Watterson
6,921,351 B1 7/2005 Hickman et al.
6,974,404 B1 12/2005 Watterson et al.
6,997,852 B2 2/2006 Watterson et al.
7,025,713 B2 4/2006 Dalebout et al.
D520,085 S 5/2006 Willardson et al.
7,044,897 B2 5/2006 Myers et al.
7,052,442 B2 5/2006 Watterson et al.
7,060,006 B1 6/2006 Watterson et al.
7,060,008 B2 6/2006 Watterson et al.
7,070,539 B2 7/2006 Brown et al.
7,097,588 B2 8/2006 Watterson et al.
D527,776 S 9/2006 Willardson et al.
7,112,168 B2 9/2006 Dalebout et al.
7,128,693 B2 10/2006 Brown et al.
7,166,062 B1 1/2007 Watterson et al.
7,166,064 B2 1/2007 Watterson et al.

(56) References Cited

U.S. PATENT DOCUMENTS

| | | | |
|---|---|---|---|
| 7,169,087 | B2 | 1/2007 | Ercanbrack et al. |
| 7,169,093 | B2 | 1/2007 | Simonson et al. |
| 7,192,388 | B2 | 3/2007 | Dalebout et al. |
| 7,250,022 | B2 | 7/2007 | Dalebout et al. |
| 7,282,016 | B2 | 10/2007 | Simonson |
| 7,285,075 | B2 | 10/2007 | Cutler et al. |
| 7,344,481 | B2 | 3/2008 | Watterson et al. |
| 7,377,882 | B2 | 5/2008 | Watterson et al. |
| 7,425,188 | B2 | 9/2008 | Ercanbrack et al. |
| 7,429,236 | B2 | 9/2008 | Dalebout et al. |
| 7,455,622 | B2 | 11/2008 | Watterson et al. |
| 7,482,050 | B2 | 1/2009 | Olson |
| D588,655 | S | 3/2009 | Utykanski |
| 7,510,509 | B2 | 3/2009 | Hickman |
| 7,537,546 | B2 | 5/2009 | Watterson et al. |
| 7,537,549 | B2 | 5/2009 | Nelson et al. |
| 7,537,552 | B2 | 5/2009 | Dalebout et al. |
| 7,540,828 | B2 | 6/2009 | Watterson et al. |
| 7,549,947 | B2 | 6/2009 | Hickman et al. |
| 7,556,590 | B2 | 7/2009 | Watterson et al. |
| 7,563,203 | B2 | 7/2009 | Dalebout et al. |
| 7,575,536 | B1 | 8/2009 | Hickman |
| 7,601,105 | B1 | 10/2009 | Gipson et al. |
| 7,604,573 | B2 | 10/2009 | Dalebout et al. |
| D604,373 | S | 11/2009 | Dalebout et al. |
| 7,618,350 | B2 | 11/2009 | Dalebout et al. |
| 7,618,357 | B2 | 11/2009 | Dalebout et al. |
| 7,625,315 | B2 | 12/2009 | Hickman |
| 7,625,321 | B2 | 12/2009 | Simonson et al. |
| 7,628,730 | B1 | 12/2009 | Watterson et al. |
| 7,628,737 | B2 | 12/2009 | Kowallis et al. |
| 7,637,847 | B1 | 12/2009 | Hickman |
| 7,645,212 | B2 | 1/2010 | Ashby et al. |
| 7,645,213 | B2 | 1/2010 | Watterson et al. |
| 7,658,698 | B2 | 2/2010 | Pacheco et al. |
| 7,674,205 | B2 | 3/2010 | Dalebout et al. |
| 7,713,171 | B1 | 5/2010 | Hickman |
| 7,713,172 | B2 | 5/2010 | Watterson et al. |
| 7,713,180 | B2 | 5/2010 | Wickens et al. |
| 7,717,828 | B2 | 5/2010 | Simonson et al. |
| 7,736,279 | B2 | 6/2010 | Dalebout et al. |
| 7,740,563 | B2 | 6/2010 | Dalebout et al. |
| 7,749,144 | B2 | 7/2010 | Hammer |
| 7,766,797 | B2 | 8/2010 | Dalebout et al. |
| 7,771,329 | B2 | 8/2010 | Dalebout |
| 7,775,940 | B2 | 8/2010 | Dalebout et al. |
| 7,789,800 | B1 | 9/2010 | Watterson et al. |
| 7,798,946 | B2 | 9/2010 | Dalebout et al. |
| 7,815,550 | B2 | 10/2010 | Watterson et al. |
| 7,857,731 | B2 | 12/2010 | Hickman et al. |
| 7,862,475 | B2 | 1/2011 | Watterson et al. |
| 7,862,478 | B2 | 1/2011 | Watterson et al. |
| 7,862,483 | B2 | 1/2011 | Hendrickson et al. |
| D635,207 | S | 3/2011 | Dalebout et al. |
| 7,901,330 | B2 | 3/2011 | Dalebout et al. |
| 7,909,740 | B2 | 3/2011 | Dalebout et al. |
| 7,980,996 | B2 | 7/2011 | Hickman |
| 7,981,000 | B2 | 7/2011 | Watterson et al. |
| 7,985,164 | B2 | 7/2011 | Ashby |
| 8,029,415 | B2 | 10/2011 | Ashby et al. |
| 8,033,960 | B1 | 10/2011 | Dalebout et al. |
| D650,451 | S | 12/2011 | Olson et al. |
| D652,877 | S | 1/2012 | Dalebout et al. |
| 8,152,702 | B2 | 4/2012 | Pacheco |
| D659,775 | S | 5/2012 | Olson et al. |
| D659,777 | S | 5/2012 | Watterson et al. |
| D660,383 | S | 5/2012 | Watterson et al. |
| D664,613 | S | 7/2012 | Dalebout et al. |
| 8,251,874 | B2 | 8/2012 | Ashby et al. |
| 8,298,123 | B2 | 10/2012 | Hickman |
| 8,298,125 | B2 | 10/2012 | Colledge et al. |
| D671,177 | S | 11/2012 | Sip |
| D671,178 | S | 11/2012 | Sip |
| D673,626 | S | 1/2013 | Olson et al. |
| 8,690,735 | B2 | 4/2014 | Watterson et al. |
| D707,763 | S | 6/2014 | Cutler |
| 8,740,753 | B2 | 6/2014 | Olson et al. |
| 8,758,201 | B2 | 6/2014 | Ashby et al. |
| 8,771,153 | B2 | 7/2014 | Dalebout et al. |
| 8,784,270 | B2 | 7/2014 | Ashby et al. |
| 8,808,148 | B2 | 8/2014 | Watterson et al. |
| 8,814,762 | B2 | 8/2014 | Butler et al. |
| D712,493 | S | 9/2014 | Ercanbrack et al. |
| 8,840,075 | B2 | 9/2014 | Dalebout et al. |
| 8,845,493 | B2 | 9/2014 | Watterson et al. |
| 8,870,726 | B2 | 10/2014 | Watterson et al. |
| 8,876,668 | B2 | 11/2014 | Hendrickson et al. |
| 8,894,549 | B2 | 11/2014 | Colledge |
| 8,894,555 | B2 | 11/2014 | Colledge et al. |
| 8,911,330 | B2 | 12/2014 | Watterson et al. |
| 8,920,288 | B2 | 12/2014 | Dalebout et al. |
| 8,986,165 | B2 | 3/2015 | Ashby |
| 8,992,364 | B2 | 3/2015 | Law et al. |
| 8,992,387 | B2 | 3/2015 | Watterson et al. |
| D726,476 | S | 4/2015 | Ercanbrack |
| 9,028,368 | B2 | 5/2015 | Ashby et al. |
| 9,028,370 | B2 | 5/2015 | Watterson et al. |
| 9,039,578 | B2 | 5/2015 | Dalebout |
| D731,011 | S | 6/2015 | Buchanan |
| 9,072,930 | B2 | 7/2015 | Ashby et al. |
| 9,119,983 | B2 | 9/2015 | Rhea |
| 9,123,317 | B2 | 9/2015 | Watterson et al. |
| 9,126,071 | B2 | 9/2015 | Smith |
| 9,126,072 | B2 | 9/2015 | Watterson |
| 9,138,615 | B2 | 9/2015 | Olson et al. |
| 9,142,139 | B2 | 9/2015 | Watterson et al. |
| 9,144,703 | B2 | 9/2015 | Dalebout et al. |
| 9,149,683 | B2 | 10/2015 | Watterson et al. |
| 9,186,535 | B2 | 11/2015 | Ercanbrack |
| 9,186,549 | B2 | 11/2015 | Watterson et al. |
| 9,254,409 | B2 | 2/2016 | Dalebout et al. |
| 9,254,416 | B2 | 2/2016 | Ashby |
| 9,278,248 | B2 | 3/2016 | Tyger et al. |
| 9,278,249 | B2 | 3/2016 | Watterson |
| 9,278,250 | B2 | 3/2016 | Buchanan |
| 9,289,648 | B2 | 3/2016 | Watterson |
| 9,339,691 | B2 | 5/2016 | Brammer |
| 9,352,185 | B2 | 5/2016 | Hendrickson et al. |
| 9,352,186 | B2 | 5/2016 | Watterson |
| 9,375,605 | B2 | 6/2016 | Tyger et al. |
| 9,381,394 | B2 | 7/2016 | Mortensen et al. |
| 9,387,387 | B2 | 7/2016 | Dalebout |
| 9,393,453 | B2 | 7/2016 | Watterson |
| 9,403,047 | B2 | 8/2016 | Olson et al. |
| 9,403,051 | B2 | 8/2016 | Cutler |
| 9,421,416 | B2 | 8/2016 | Mortensen et al. |
| 9,457,219 | B2 | 10/2016 | Smith |
| 9,457,220 | B2 | 10/2016 | Olson |
| 9,457,222 | B2 | 10/2016 | Dalebout |
| 9,460,632 | B2 | 10/2016 | Watterson |
| 9,463,356 | B2 | 10/2016 | Rhea |
| 9,468,794 | B2 | 10/2016 | Barton |
| 9,468,798 | B2 | 10/2016 | Dalebout |
| 9,480,874 | B2 | 11/2016 | Cutler |
| 9,492,704 | B2 | 11/2016 | Mortensen et al. |
| 9,498,668 | B2 | 11/2016 | Smith |
| 9,517,378 | B2 | 12/2016 | Ashby et al. |
| 9,521,901 | B2 | 12/2016 | Dalebout |
| 9,533,187 | B2 | 1/2017 | Dalebout |
| 9,539,461 | B2 | 1/2017 | Ercanbrack |
| 9,579,544 | B2 | 2/2017 | Watterson |
| 9,586,086 | B2 | 3/2017 | Dalebout et al. |
| 9,586,090 | B2 | 3/2017 | Watterson et al. |
| 9,604,099 | B2 | 3/2017 | Taylor |
| 9,616,276 | B2 | 4/2017 | Dalebout et al. |
| 9,616,278 | B2 | 4/2017 | Olson |
| 9,623,281 | B2 | 4/2017 | Hendrickson et al. |
| 9,636,567 | B2 | 5/2017 | Brammer et al. |
| 9,675,839 | B2 | 6/2017 | Dalebout et al. |
| 9,682,307 | B2 | 6/2017 | Dalebout |
| 9,694,242 | B2 | 7/2017 | Ashby et al. |
| 9,737,755 | B2 | 8/2017 | Dalebout |
| 9,757,605 | B2 | 9/2017 | Olson et al. |
| 9,764,186 | B2 | 9/2017 | Dalebout et al. |

(56) References Cited

U.S. PATENT DOCUMENTS

| | | | |
|---|---|---|---|
| 9,767,785 | B2 | 9/2017 | Ashby et al. |
| 9,795,822 | B2 | 10/2017 | Smith et al. |
| 9,808,672 | B2 | 11/2017 | Dalebout |
| 9,849,326 | B2 | 12/2017 | Smith |
| 9,878,210 | B2 | 1/2018 | Watterson |
| 9,889,334 | B2 | 2/2018 | Ashby et al. |
| 9,889,339 | B2 | 2/2018 | Douglass |
| 9,937,376 | B2 | 4/2018 | McInelly et al. |
| 9,937,377 | B2 | 4/2018 | McInelly et al. |
| 9,937,378 | B2 | 4/2018 | Dalebout et al. |
| 9,937,379 | B2 | 4/2018 | Mortensen et al. |
| 9,943,719 | B2 | 4/2018 | Smith et al. |
| 9,943,722 | B2 | 4/2018 | Dalebout |
| 9,948,037 | B2 | 4/2018 | Ashby |
| 9,968,816 | B2 | 5/2018 | Olson et al. |
| 9,968,821 | B2 | 5/2018 | Finlayson et al. |
| 9,968,823 | B2 | 5/2018 | Cutler |
| 10,010,755 | B2 | 7/2018 | Watterson |
| 10,010,756 | B2 | 7/2018 | Watterson |
| 10,029,145 | B2 | 7/2018 | Douglass |
| D826,350 | S | 8/2018 | Hochstrasser |
| 10,046,196 | B2 | 8/2018 | Ercanbrack et al. |
| D827,733 | S | 9/2018 | Hochstrasser |
| 10,065,064 | B2 | 9/2018 | Smith et al. |
| 10,071,285 | B2 | 9/2018 | Smith et al. |
| 10,085,586 | B2 | 10/2018 | Smith et al. |
| 10,086,254 | B2 | 10/2018 | Watterson |
| 10,136,842 | B2 | 11/2018 | Ashby |
| 10,186,161 | B2 | 1/2019 | Watterson |
| 10,188,890 | B2 | 1/2019 | Olson et al. |
| 10,207,143 | B2 | 2/2019 | Dalebout et al. |
| 10,207,145 | B2 | 2/2019 | Tyger et al. |
| 10,207,147 | B2 | 2/2019 | Ercanbrack et al. |
| 10,207,148 | B2 | 2/2019 | Powell et al. |
| 10,212,994 | B2 | 2/2019 | Watterson et al. |
| 10,220,259 | B2 | 3/2019 | Brammer |
| 10,226,396 | B2 | 3/2019 | Ashby |
| 10,226,664 | B2 | 3/2019 | Dalebout et al. |
| 10,252,109 | B2 | 4/2019 | Watterson |
| 10,258,828 | B2 | 4/2019 | Dalebout et al. |
| 10,272,317 | B2 | 4/2019 | Watterson |
| 10,279,212 | B2 | 5/2019 | Dalebout et al. |
| 10,293,211 | B2 | 5/2019 | Watterson et al. |
| D852,292 | S | 6/2019 | Cutler |
| 10,343,017 | B2 | 7/2019 | Jackson |
| 10,376,736 | B2 | 8/2019 | Powell et al. |
| 10,388,183 | B2 | 8/2019 | Watterson |
| 10,391,361 | B2 | 8/2019 | Watterson |
| D864,320 | S | 10/2019 | Weston |
| D864,321 | S | 10/2019 | Weston |
| 10,426,989 | B2 | 10/2019 | Dalebout |
| 10,433,612 | B2 | 10/2019 | Ashby et al. |
| 10,441,840 | B2 | 10/2019 | Dalebout |
| 10,441,844 | B2 | 10/2019 | Powell |
| 10,449,416 | B2 | 10/2019 | Dalebout et al. |
| 10,471,299 | B2 | 11/2019 | Powell |
| D868,909 | S | 12/2019 | Cutler et al. |
| 10,492,519 | B2 | 12/2019 | Capell et al. |
| 10,493,349 | B2 | 12/2019 | Watterson |
| 10,500,473 | B2 | 12/2019 | Watterson |
| 10,537,764 | B2 | 1/2020 | Smith et al. |
| 10,543,395 | B2 | 1/2020 | Powell et al. |
| 10,561,877 | B2 | 2/2020 | Workman |
| 10,561,893 | B2 | 2/2020 | Chatterton et al. |
| 10,561,894 | B2 | 2/2020 | Dalebout et al. |
| 10,569,121 | B2 | 2/2020 | Watterson |
| 10,569,123 | B2 | 2/2020 | Hochstrasser et al. |
| 10,625,114 | B2 | 4/2020 | Ercanbrack |
| 10,625,137 | B2 | 4/2020 | Dalebout et al. |
| 10,661,114 | B2 | 5/2020 | Watterson et al. |
| 10,668,320 | B2 | 6/2020 | Watterson |
| 10,671,705 | B2 | 6/2020 | Capell et al. |
| 10,688,346 | B2 | 6/2020 | Brammer |
| 10,702,736 | B2 | 7/2020 | Weston et al. |
| 10,709,925 | B2 | 7/2020 | Dalebout et al. |
| 10,726,730 | B2 | 7/2020 | Watterson |
| 10,729,965 | B2 | 8/2020 | Powell |
| 10,758,767 | B2 | 9/2020 | Olson et al. |
| 10,786,706 | B2 | 9/2020 | Smith |
| 10,864,407 | B2 | 12/2020 | Watterson et al. |
| 10,918,905 | B2 | 2/2021 | Powell et al. |
| 10,932,517 | B2 | 3/2021 | Ashby et al. |
| 10,940,360 | B2 | 3/2021 | Dalebout et al. |
| 10,953,268 | B1 | 3/2021 | Dalebout et al. |
| 10,953,305 | B2 | 3/2021 | Dalebout et al. |
| 10,967,214 | B1 | 4/2021 | Olson et al. |
| 10,994,173 | B2 | 5/2021 | Watterson |
| 11,000,730 | B2 | 5/2021 | Dalebout et al. |
| 11,013,960 | B2 | 5/2021 | Watterson et al. |
| 11,033,777 | B1 | 6/2021 | Watterson et al. |
| 11,058,913 | B2 | 7/2021 | Dalebout et al. |
| 11,058,914 | B2 | 7/2021 | Powell |
| 11,058,918 | B1 | 7/2021 | Watterson et al. |
| 11,187,285 | B2 | 11/2021 | Wrobel |
| 2005/0049121 | A1* | 3/2005 | Dalebout ..... A63B 21/078 482/129 |
| 2016/0058335 | A1 | 3/2016 | Ashby |
| 2016/0346595 | A1 | 12/2016 | Dalebout et al. |

* cited by examiner

STRENGTH TRAINING APPARATUS

CROSS REFERENCE TO RELATED APPLICATIONS

This application is a divisional of U.S. application Ser. No. 16/923,275, filed on Jul. 8, 2020, which is a continuation of U.S. application Ser. No. 16/404,413, filed on May 6, 2019, now U.S. Pat. No. 10,709,925, which is a continuation of U.S. application Ser. No. 15/472,954, filed on Mar. 29, 2017, now U.S. Pat. No. 10,279,212, which is a continuation of U.S. application Ser. No. 15/019,088, filed on Feb. 9, 2016, now U.S. Pat. No. 9,616,276, which is a continuation of U.S. application Ser. No. 14/213,793, filed on Mar. 14, 2014, now U.S. Pat. No. 9,254,409, which claims priority to U.S. Provisional Patent Application No. 61/786,007, filed on Mar. 14, 2013. Each of the aforementioned applications is incorporated herein by reference in its entirety.

TECHNICAL FIELD

The present disclosure relates to exercise equipment. More particularly, the present disclosure relates to strength training equipment and to related methods.

BACKGROUND

While there are numerous exercise activities that one may participate in, exercise may be broadly broken into the categories of aerobic exercise and anaerobic exercise. Aerobic exercise generally refers to activities that substantially increase the heart rate and respiration of the exerciser for an extended period of time. This type of exercise is generally directed to enhancing cardiovascular performance. Such exercise usually includes low or moderate resistance to the movement of the individual. For example, aerobic exercise includes activities such as walking, running, jogging, swimming or bicycling for extended distances and extended periods of time.

Anaerobic exercise generally refers to exercise that strengthens skeletal muscles and usually involves the flexing or contraction of targeted muscles through significant exertion during a relatively short period of time and/or through a relatively small number of repetitions. For example, anaerobic exercise includes activities such as weight training, push-ups, sit-ups, pull-ups or a series of short sprints.

When exercising at home or in a gym, aerobic and anaerobic exercise usually involves the use of different types of equipment. For example, aerobic exercise usually involves equipment such as treadmills, ellipticals and bicycles (traditional and stationary) while anaerobic exercise often involves the use of free weights, weight stacks, or other cable and pulley resistance-type systems.

Often, individuals will plan their work-out routines to include both aerobic and anaerobic activities. For example, a person may do anaerobic exercises (e.g., weight lifting and other strength training exercises) on two or three days of the week while doing aerobic exercising (e.g., running, bicycling) on the remaining days of the week. In other instances, an individual may do both aerobic and anaerobic activities during the same day.

One of the difficulties in integrating both aerobic and anaerobic activities is the ability of an individual to efficiently and effectively track their progress. For example, many individuals use aerobic exercise equipment such as a treadmill or an elliptical machine to automatically track the calories that they've burned while using such equipment.

However, it is more difficult to track or calculate such information when doing strength training exercises.

A couple of examples of equipment that has tried to combine aerobic exercising with anaerobic exercising are described in U.S. Pat. No. 5,527,245 to Dalebout et al. and U.S. Pat. No. 7,740,563 to Dalebout et al. These patents describe a resistance-type strength training apparatus combined with, in one instance, a treadmill, and in another instance an elliptical device.

In view of the foregoing, it would be desirable to provide the ability to track one's progress during exercise in a manner that is applicable to both aerobic and anaerobic activities and which is simple and effective. Additionally, it is a general desire in the industry to provide exercise equipment with new features and enhanced performance.

SUMMARY

In one aspect of the disclosure, a strength training apparatus includes a base member and a tower structure coupled with the base member.

In one or more other aspects that may be combined with any of the aspects herein, may further include at least one arm that is pivotally coupled with the tower structure.

In one or more other aspects that may be combined with any of the aspects herein, may further include a flywheel and a cable and pulley system associated with the at least one arm, wherein displacement of at least one cable of the cable and pulley system affects rotation of the flywheel.

In one or more other aspects that may be combined with any of the aspects herein, may further include a braking mechanism associated with a flywheel and configured to apply a selected resistance to the rotation of the flywheel.

In one or more other aspects that may be combined with any of the aspects herein, may further include a braking mechanism including a magnetic braking mechanism.

In one or more other aspects that may be combined with any of the aspects herein, may further include a torque sensor associated with the flywheel.

In one or more other aspects that may be combined with any of the aspects herein, may further include a console having at least one input device and at least one output device.

In one or more other aspects that may be combined with any of the aspects herein, may further include the console in communication with the braking mechanism, wherein the at least one input device controls the amount of resistance applied to the flywheel by the braking mechanism.

In one or more other aspects that may be combined with any of the aspects herein, may further include the console in communication with the torque sensor, wherein the at least one output device provides an indication of the amount of work expended by a user upon rotation of the flywheel.

In one or more other aspects that may be combined with any of the aspects herein, may further include the at least one output device provides the indication of the amount of work expended in units of watts.

In one or more other aspects that may be combined with any of the aspects herein, may further include the strength training apparatus including a drive mechanism associated with the flywheel.

In one or more other aspects that may be combined with any of the aspects herein, may further include a clutch mechanism coupled with the flywheel by way of a drive belt.

In one or more other aspects that may be combined with any of the aspects herein, may further include the clutch mechanism enabling the rotation of the flywheel in a first rotational direction upon the displacement of the at least one cable in a first defined direction, but has no effect on the flywheel upon displacement of the at least one cable in a second defined direction, the second defined direction being the opposite of the first defined direction.

In one or more other aspects that may be combined with any of the aspects herein, may further include the drive mechanism having a drive chain coupled with the cable and pulley system, wherein the drive chain extends about a plurality of sprockets including at least one sprocket that is displaceable relative to the tower.

In one or more other aspects that may be combined with any of the aspects herein, may further include at least one biasing member coupled with the at least one displaceable sprocket.

In one or more other aspects that may be combined with any of the aspects herein, may further include an embodiment where the at least one arm includes a pair of arms, wherein the cable and pulley system includes a first pulley coupled with a first arm of the pair of arms with a first cable extending through the first pulley and a second pulley coupled with the second arm with a second cable extending through the second pulley.

In one or more other aspects that may be combined with any of the aspects herein, may further include the pair of arms maintained in a fixed angular position relative to each other.

In another aspect of the disclosure, a method of conducting strength training includes applying a force to a cable and displacing the cable in a first direction and affecting rotation of a flywheel upon displacement of the cable.

In one or more other aspects that may be combined with any of the aspects herein, may further include a resistance applied to the flywheel and the torque applied to the flywheel being measured, such as by way of a sensor.

In one or more other aspects that may be combined with any of the aspects herein, may further include calculating the work performed, in watts, based at least in part on the measured torque.

In one or more other aspects that may be combined with any of the aspects herein, may further include applying resistance to the flywheel by applying resistance using a magnetic brake.

In one or more other aspects that may be combined with any of the aspects herein, may further include the resistance applied by the magnetic brake being selectively varied.

In one or more other aspects that may be combined with any of the aspects herein, may further include applying a force to a cable including pulling the cable through a pulley, and selectively positioning the pulley at one of a variety of positions prior to pulling the cable through the pulley.

In one or more other aspects that may be combined with any of the aspects herein, may further include a method of tracking work expended during exercising including conducting an aerobic exercise activity and determining the work expended during the aerobic exercise activity and expressing the work expended in units of watts.

In one or more other aspects that may be combined with any of the aspects herein, may further include an embodiment where an anaerobic exercise activity is conducted and the work expended during the anaerobic exercise activity is determined and expressed in units of watts.

In one or more other aspects that may be combined with any of the aspects herein, may further include summing the amount of work expended during the aerobic activity and the amount of work expended during the anaerobic activity.

BRIEF DESCRIPTION OF THE DRAWINGS

The accompanying drawings illustrate various embodiments of the present methods and systems and are a part of the specification. The illustrated embodiments are merely examples of the present systems and methods and do not limit the scope thereof.

Throughout the drawings, identical reference numbers designate similar, but not necessarily identical, elements.

DETAILED DESCRIPTION

Figure 1:
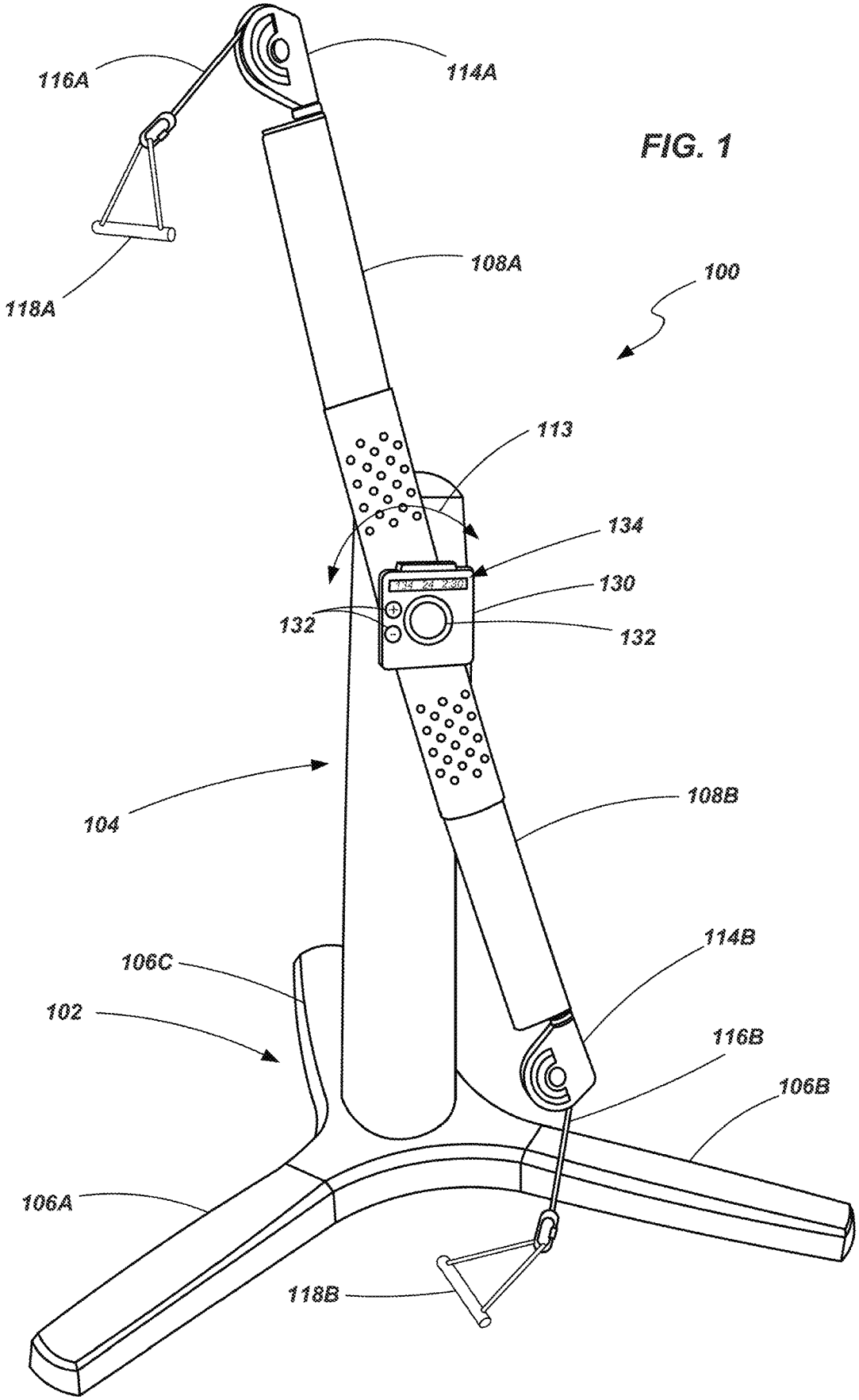
FIG. 1 is a perspective view of a strength training apparatus.
Figure 2:
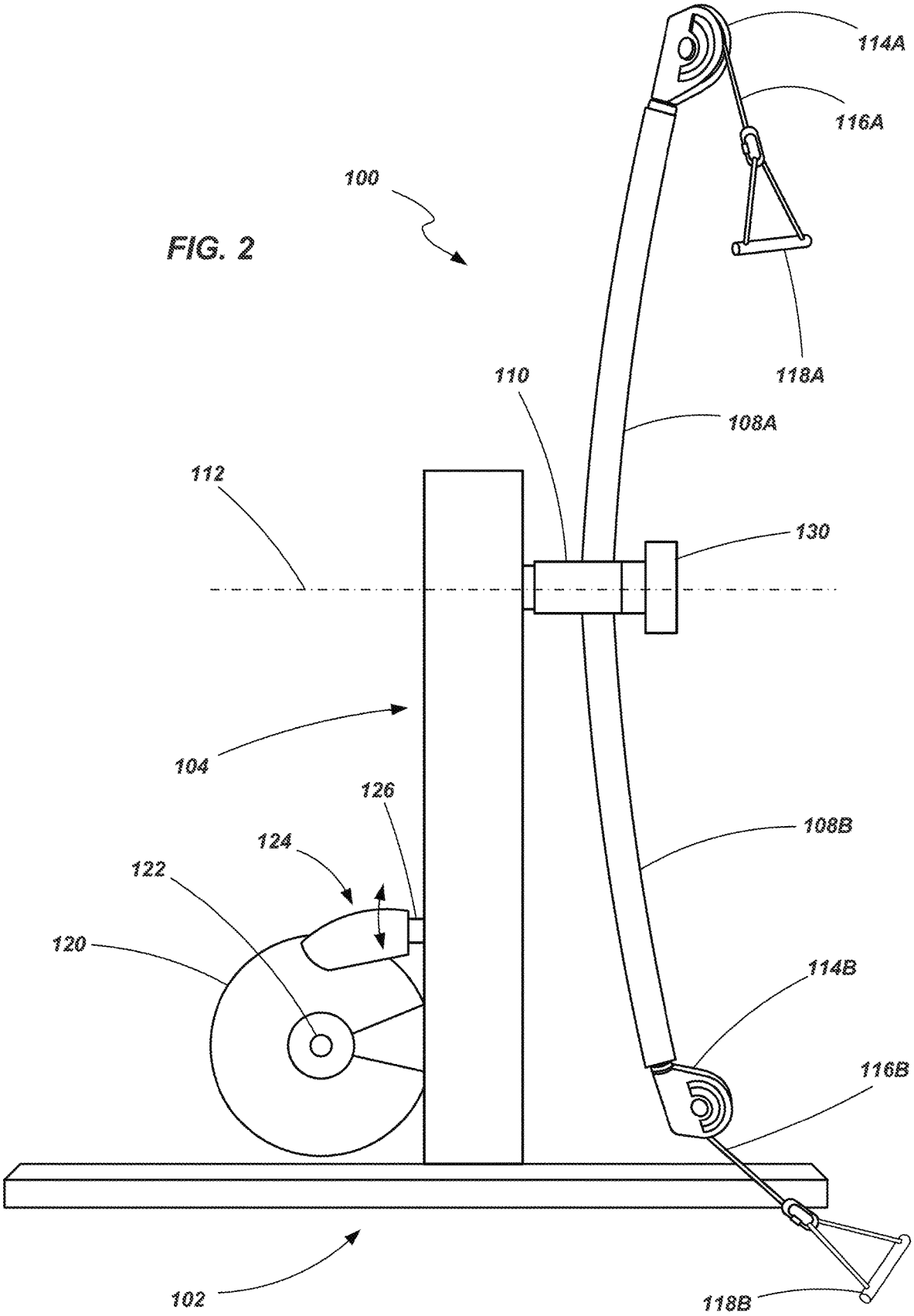
FIG. 2 is a first side view of the strength training apparatus shown in FIG. 1.
Figure 3:
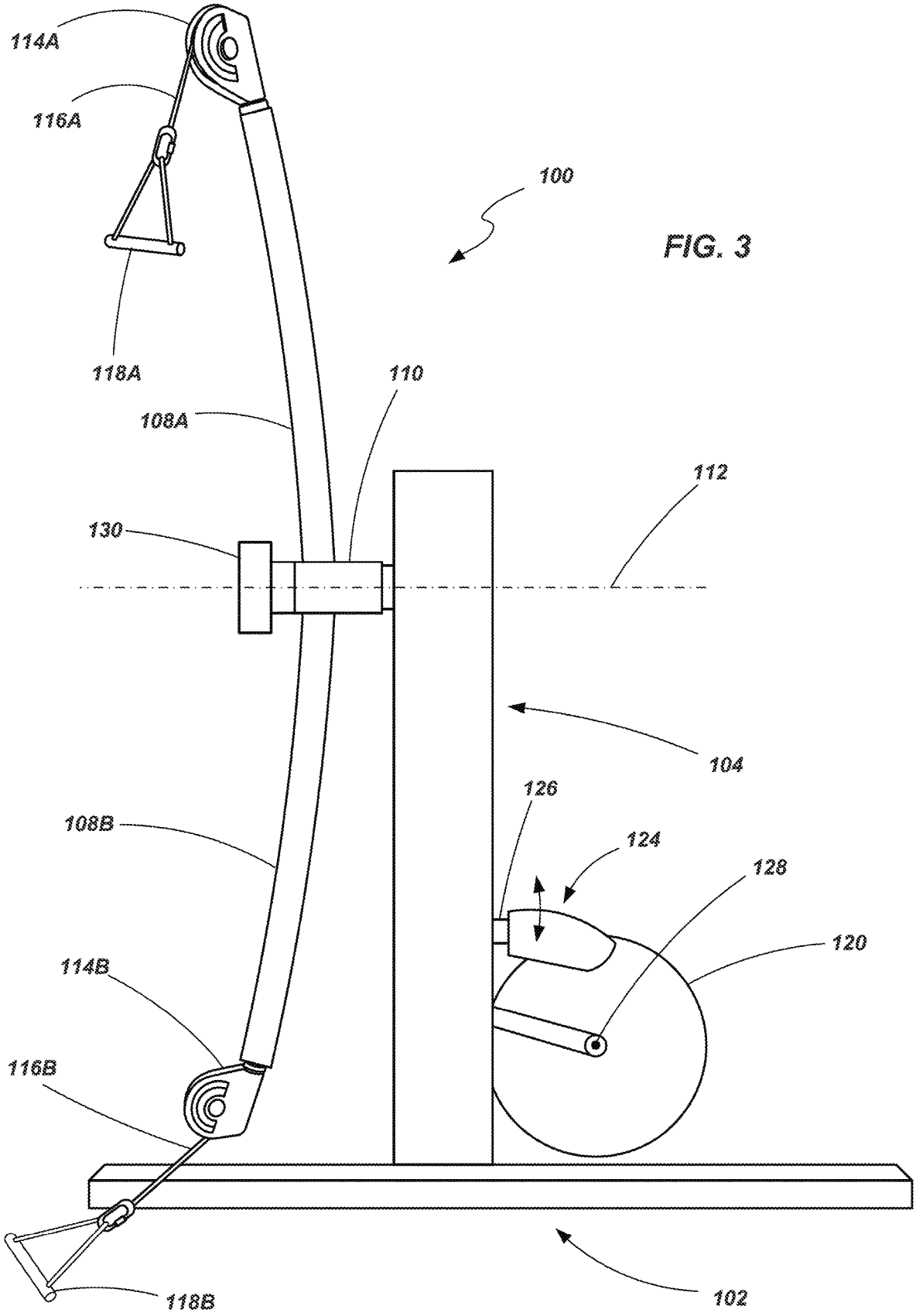
FIG. 3 is another side view of the strength training apparatus shown in FIG. 1.

Referring to FIGS. 1-3, a strength training apparatus 100 is provided. The apparatus 100, according to certain embodiments, includes a base member 102 and a tower 104 or support structure coupled to, and extending upward from, the base member 102. The base may be configured to include a plurality of legs 106A-106C extending away from each other to provide a stable base or platform for the apparatus 100 and to support the apparatus 100 when forces are applied to it by someone using the apparatus 100 to exercise. In the embodiment shown in FIGS. 1-3, the base member 102 includes three legs. However, it is noted that other configurations are contemplated.

A pair of arms 108A and 108B are pivotally coupled to the tower 104 by way of a bearing 110 or other mechanical structure. The bearing 110 enables the arms 108A and 108B to rotate about a defined axis 112 (FIGS. 2 and 3) relative to the tower 104 and base member 102 as indicated by directional arrow 113 (FIG. 1). In one embodiment, the arms 108A and 108B may be configured to maintain a constant angular relationship relative to each other as they are rotated about the axis 112 (e.g., they may continually extend in substantially opposite directions from each other). In another embodiment, each arm 108A and 108B may be selectively positionable (manually, or by a motor or other actuator (not shown)) independent of the other so that they may be positioned at any of a variety of angles relative to each other.

The apparatus 100 also includes a pair of pulleys 114A and 114B, one being pivotally coupled to the end of each arm 108A and 108B. Cables 116A and 116B extend through each pulley 114A and 114B and are coupled with handles 118A and 118B. As will be described in further detail below, the handles 118A and 118B, the cables 116A and 116B and the pulleys 114A and 114B are part of a cable/pulley system that provides resistance to an individual that is using the apparatus 100 for strength training.

As seen in FIGS. 2 and 3, a flywheel 120 is coupled to either the base member 102 or the tower 104 (or to both) and configured to rotate about a shaft 122. A resistance or braking mechanism 124 is positioned adjacent the flywheel 120 and is selectively adjustable so as to apply a desired level of resistance to the rotation of the flywheel 120. Various types of braking mechanisms may be used including, in one embodiment, straps or pads that apply friction to the flywheel 120. In one embodiment, a magnetic brake (sometimes referred to as an eddy current brake) may be used to provide an adjustable level of resistance applied to the flywheel 120.

When the braking mechanism 124 is configured as a magnetic mechanism it may include an arm 126 that is pivotally coupled with the tower 104 and which contains a plurality of magnets arranged to provide a desired magnetic flux. As the arm 126 is rotated relative to tower 104 (and, thus, the flywheel 120), the magnetic flux through which the flywheel 120 rotates changes, thereby altering the amount of rotational resistance experienced by the flywheel 120.

The flywheel 120, when configured to interact with a magnetic braking mechanism, may include ferrous components, non-ferrous components, or both. In one embodiment, the flywheel 120 may include a relatively dense ferrous component to impart a desired level of rotational inertia to the flywheel 120. The flywheel 120 may also include a nonferrous component to provide increased braking resistance when used with a magnetic brake mechanism. For example, one embodiment may include a portion that is formed of cast iron (a ferrous material) to provide the desired rotational inertia with another portion formed of an aluminum material (to provide increased braking response to the magnetic mechanism). One such configuration of a flywheel, as well as an associated magnetic braking mechanism, is described by U.S. Patent Application Publication No. 2012/0088638 to Lull (application Ser. No. 13/267,719), the disclosure of which is incorporated by reference herein in its entirety.

A torque sensor 128 may be associated with the shaft 122 to determine the amount of torque applied to the flywheel 120 by a drive mechanism (discussed below). Various types of torque sensors may be utilized. One example of a torque sensor includes that which is described in U.S. Pat. No. 7,011,326 to Schroeder et al., the disclosure of which is incorporated by reference herein in its entirety. Another example of a torque sensor includes that which is described in U.S. Pat. No. 7,584,673 to Shimizu, the disclosure of which is incorporated by reference herein in its entirety.

The apparatus further includes a control panel 130 which may be located adjacent the bearing 110 or some other convenient location (e.g., on the tower 104). The control panel 130 may include various input devices 132 (e.g., buttons, switches or dials) and output devices 134 (e.g., LED lights, displays, alarms) to provide means of interaction with a user of the apparatus 100. The control panel 130 may further include connections for communication with other devices. The controller may include a processor and memory to provide various functions in controlling components of the apparatus 100 (e.g., the braking mechanism), in communicating with various components (e.g., the torque sensor) and making certain calculations as will be discussed below.

In one example, one of the input devices 132 of the control panel 130 may be used to set a desired resistance level that is to be applied to the flywheel 120 by controlling an actuating member associated with the braking mechanism 124. An output device 134 (e.g., a display) may indicate the current or selected level of resistance. An output device 134 of the control panel 130 may also provide an indication of the amount of work performed within a period of time calculated, for example, based on the torque applied to the flywheel 120 as measured by the torque sensor 128.

Figure 4A:
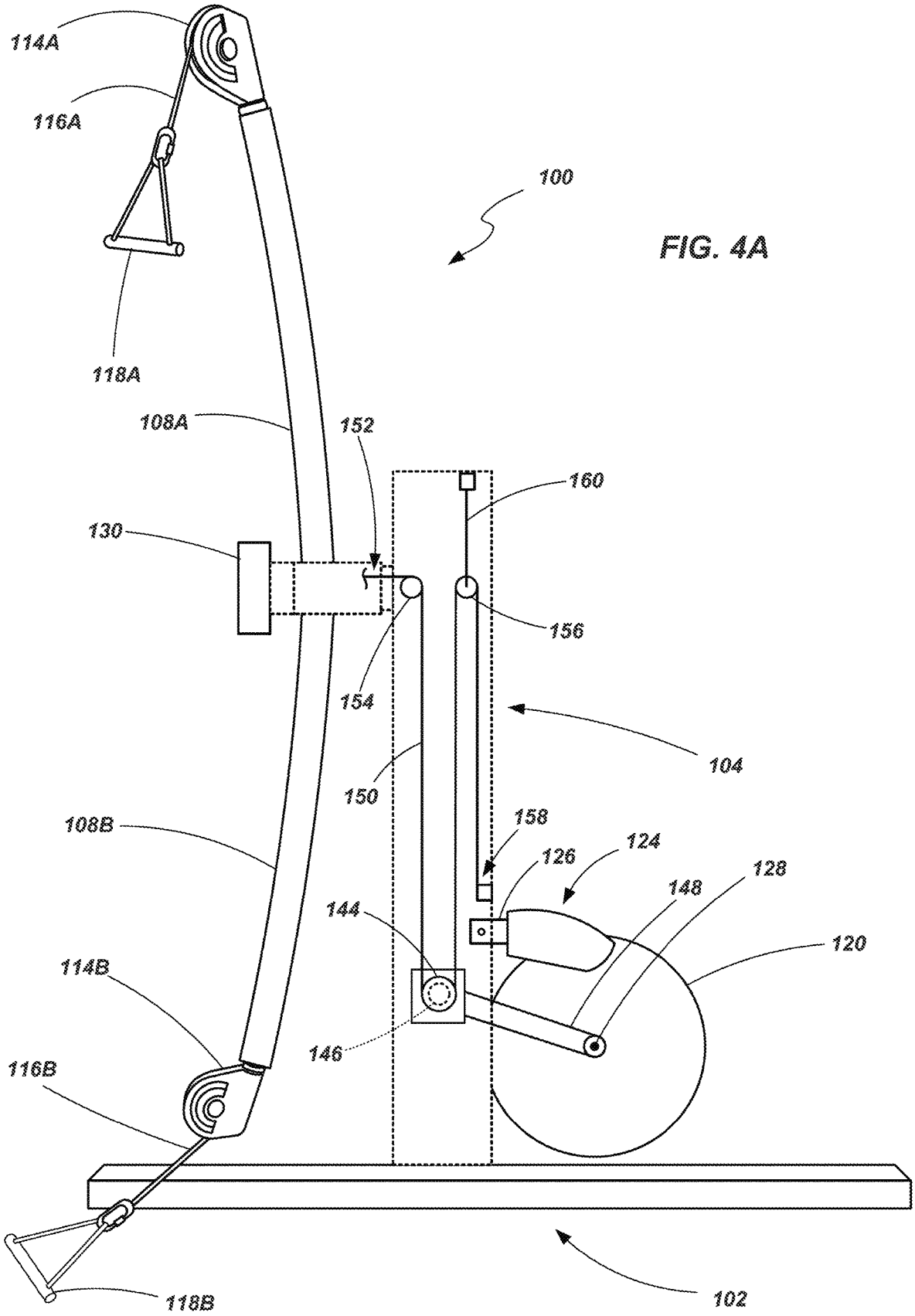
FIGS. 4A and 4B show a side view and a rear view, respectively, of the apparatus shown in FIG. 1, including various components, when the apparatus is in a first state.
Figure 4B:
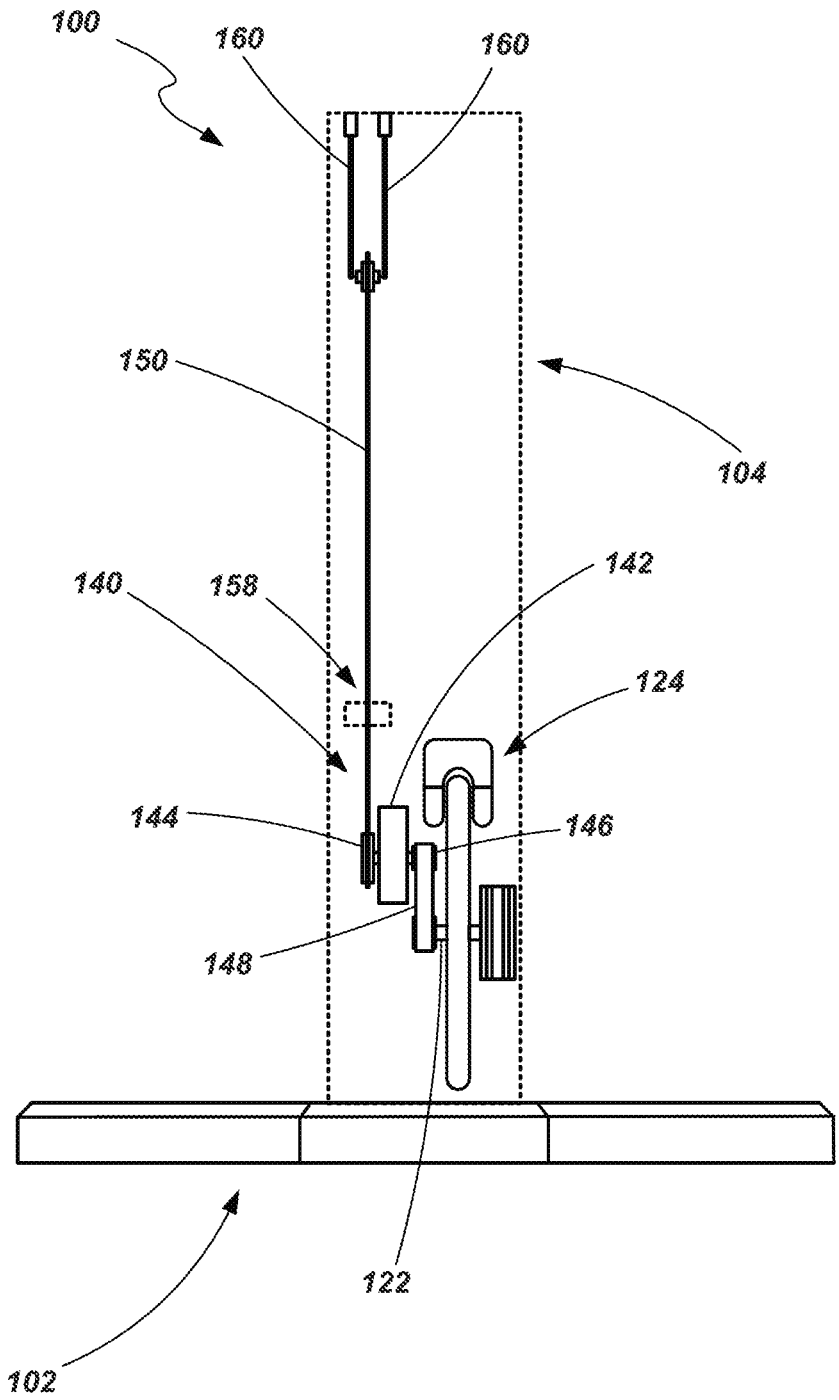

Referring now to FIGS. 4A and 4B, a side view and a rear view of the apparatus 100 is shown with various components which may be disposed within the tower 104 or otherwise arranged to assist in driving flywheel 120. It is noted that FIG. 4B does not depict the arms 108A and 108B (and associated components) for purposes of clarity and convenience. A drive mechanism 140 may include a clutch mechanism 142 having an input shaft 144 and an output shaft 146. A drive belt 148 (or drive chain or other similar drive structure) may extend about the output shaft 146 and also about the shaft 122 of the flywheel 120 (or associated pulleys coupled with the shafts). The clutch mechanism 142 is configured such that, when the input shaft 144 is rotated in a first specified direction, the output shaft 146 is likewise rotated in a specified direction displacing the drive belt 148 and, ultimately, driving the flywheel 120 in a desired direction. However, if the input shaft 144 is rotated in a second direction, opposite that of the first direction, it has no effect on the output shaft 146. Rather, the output shaft 146 is enabled to continue rotating in its initially specified direction and does not reverse directions. It is noted that, in other embodiments, the clutch mechanism 142 may be coupled directly to the flywheel 120.

A drive chain 150 (or drive belt or cable or other appropriate structure) has a first end 152 that is coupled to the cables 116A and 116B that extend through pulleys 114A and 114B and either extend through, or adjacent to, the arms 108A and 108B. The drive chain 150 extends through several pulleys or sprockets including, for example, a first sprocket 154, the input shaft 144 (or an associated pulley or sprocket coupled therewith) and a second sprocket 156. A second end 158 of the drive chain 150 may be fixed, for example, to a frame or other component associated with the tower 104. In the embodiment shown in FIGS. 4A and 4B, the first sprocket 154 is rotatable about an axis which is fixed relative to the tower 104. The second sprocket 156 is rotatable about an axis which is displaceable relative to the tower 104. For example, one or more biasing members 160 may be coupled between the second sprocket 156 and the tower 104 (or some component thereof) enabling the second sprocket 156 to be displaced relative to the tower 104. Guide members may be used to help constrain or control the displacement of the sprocket along a desired path.

Figure 5A:
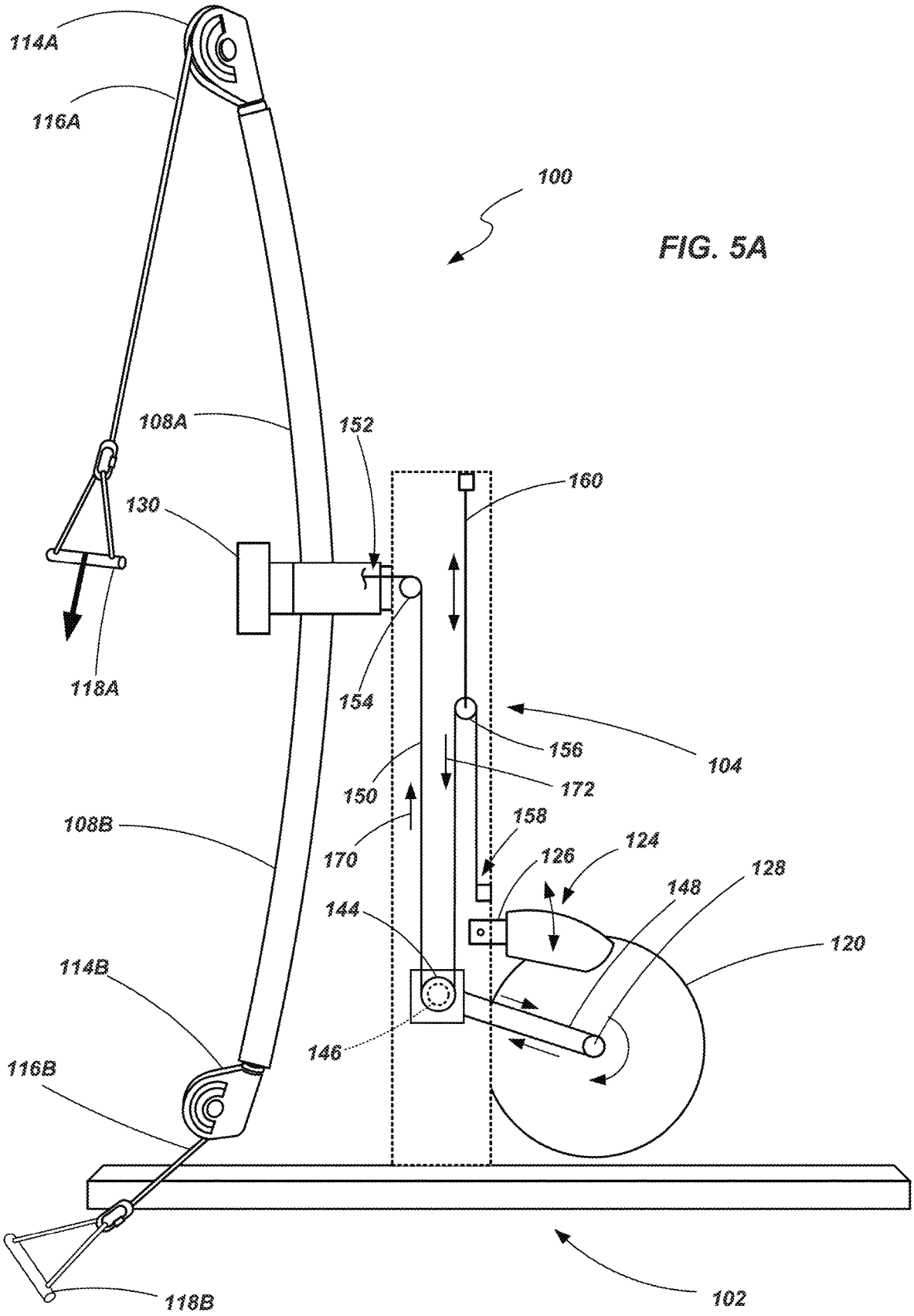
FIGS. 5A and 5B show a side view and a rear view, respectively, of the apparatus shown in FIG. 1, including various components, when the apparatus is in a second state.
Figure 5B:
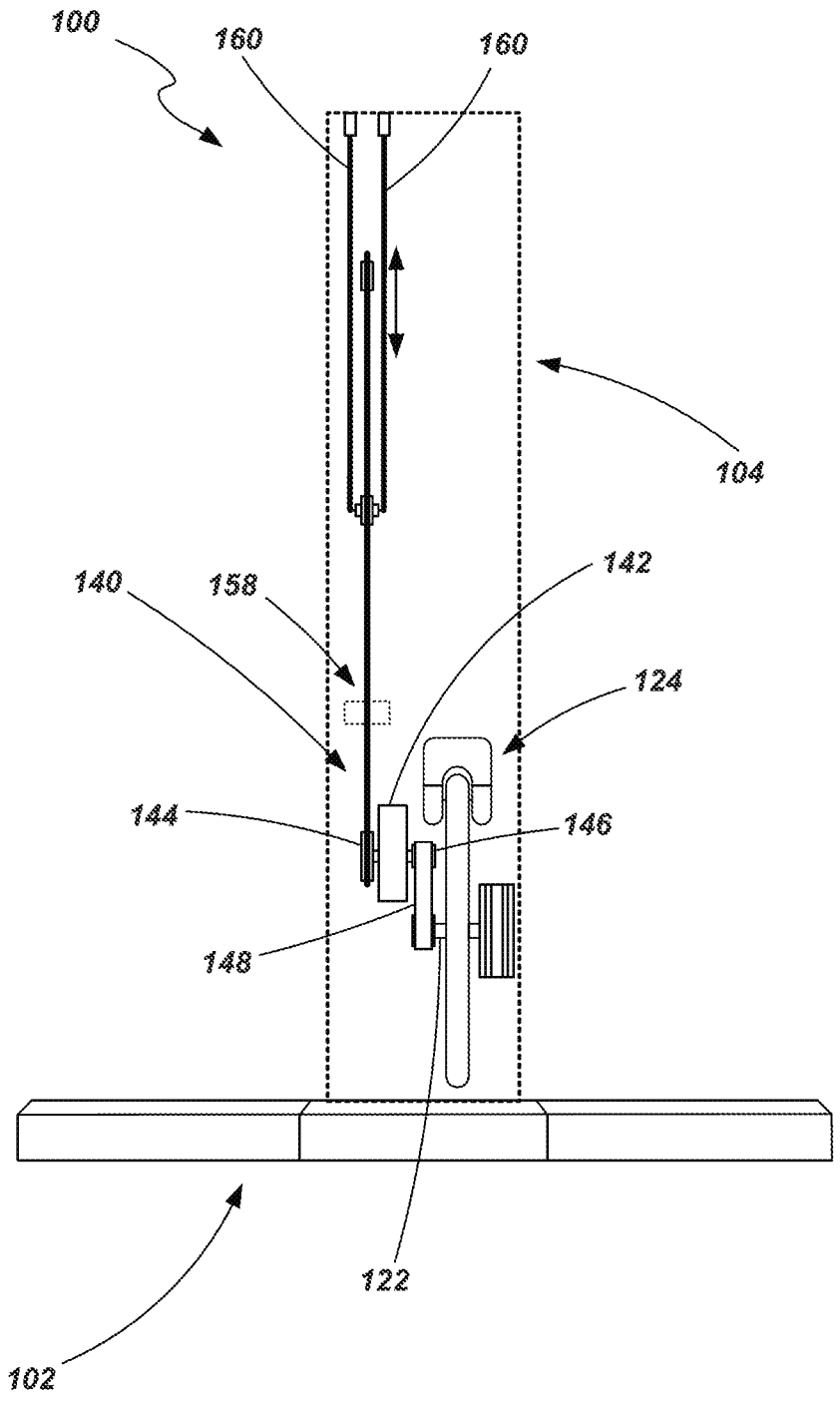

Referring briefly to FIGS. 5A and 5B, views similar to those depicted in FIGS. 4A and 4B, respectively, show certain components in a second position or state. Specifically, FIG. 5A depicts the displacement of a handle 118A due to application of a force by an individual during exercise. Displacement of the handle 118A results in displacement of the associated cable 116A and, ultimately, displacement of the drive chain 150. As indicated in FIG. 5A, a first portion of the drive chain 150 is displaced upwards towards the first sprocket 154 as indicated by directional arrow 170 while a second portion of the drive chain 150 is displaced downwards away from the second sprocket 156 and towards the input shaft 144 as indicated by directional arrow 172. It is noted that this displacement of the drive chain 150 also includes the downward displacement of the second sprocket 156 against the force of the biasing members 160 as seen in both FIGS. 5A and 5B. The displacement of the drive chain 150 results in the rotation of the input shaft 144, actuating the drive mechanism 140 such that the drive belt 148 drives the flywheel 120.

Upon release of the force applied to the handle 118A, the biasing members 160 pull the second sprocket 156 back to its previous position bringing the various components (e.g., drive chain 150, cable 116A and handle 118A) back to the positions shown in FIGS. 4A and 4B. However, as noted above, the return of the drive chain 150 to its previous position does not cause the flywheel 120 to rotate in the opposite direction or otherwise hinder its continued rotation due to the directional preference of the clutch mechanism 142. It is noted that, while the example shown in FIGS. 5A and 5B is described in terms of one particular handle (i.e., 118A) being displaced, the same functionality applies to the displacement to the other handle (i.e., 118B) or to both of them being substantially simultaneously displaced.

INDUSTRIAL APPLICABILITY

During exercise, many individuals desire to focus on anaerobic strength training, or to integrate anaerobic strength training with aerobic work-outs. One of the difficulties in mixing both aerobic and anaerobic activities is the ability of an individual to efficiently and effectively track their progress. For example, many individuals use aerobic exercise equipment such as a treadmill, an elliptical machine or a pedometer to help track the calories that they've burned while using such equipment. However, it is more difficult to track or calculate such information when doing strength training types of exercises.

The exercise apparatus provided herein provides a strength training apparatus that enables a variety of exercises while also providing the ability to track the work performed by an individual during their exercise session. By positioning the adjustable arms at different locations relative to the tower, different types of exercises may be conducted. For example, due to the adjustability of the arms/pulleys, the exercise apparatus may be used to perform exercises including, but not limited to, standing abdominal crunches, curls and other bicep exercises, lat pull-downs, chest presses, incline and decline presses, overhead presses, triceps extensions, shoulder extensions, leg extensions, leg curls, abduction and adduction exercises, and a variety of other exercises, including variations of the examples provided.

Additionally, the use of a flywheel in connection with a strength training apparatus provides a different form of resistance than in conventional strength training exercises, one that can be measured, tracked and incorporated into a planned exercise routine. The flywheel, combined with a braking mechanism such as a magnetic brake, enables considerable flexibility in setting the desired resistance during exercise. In many conventional strength training exercises, the amount of resistance provided (e.g., by free weights, weight stacks or resistance bands) is only adjustable in set increments (e.g., 5 or 10 pound increments). The use of a flywheel with a variable resistance braking mechanism enables fine tuning of the resistance over a continuous spectrum between two defined limits.

The use of a torque sensor in conjunction with the flywheel enables the calculation of work, power or energy so that, for example, a user of the apparatus may determine their performance level while using the exercise apparatus. In one particular example, the power expended during an exercise session may be expressed in watts (i.e., joules/sec (J/s) or newton meters I sec (N*m/s). A user of the machine can review the power expended during an exercise session from a display (or other output device) associated with the exercise apparatus and then compare their performance to a goal or a benchmark.

Such a way of tracking the effort expended during an anaerobic exercise routine provides more insight into the progress of the individual than just the number of repetitions completed during a given work-out session. If desired, other units may be utilized to track the energy expended by an individual during a work-out session. For example, rather than expressing the work-out performance in terms of watts (units of power), it could be expressed in terms of joules (units of work).

This information could be used with information from other work-out activities, including aerobic exercise, to consistently monitor the performance of an individual over a desired period of time. For example, rather than expressing the performance of an individual on a treadmill or an elliptical machine in terms of calories, those performances may similarly be provided in terms of watts (or another selected unit) so that all types of exercise activity may be monitored uniformly. An individual may then customize their exercise routine based, for example, on the amount of work that is to be performed regardless of whether that work occurs during an aerobic or an anaerobic activity.

One example of customizing a work-out that may be utilized in conjunction with the exercise apparatus described herein is set forth in U.S. patent application Ser. No. 13/754,361, filed on Jan. 30, 2013, which published on Aug. 1, 2013 as U.S. Patent Application Publication No. 2013/0196821 A1 ("the '821 Publication"), the disclosure of which is incorporated by reference herein in its entirety. One particular example of tracking a work-out across various exercise equipment and which may be utilized in conjunction with the exercise apparatus described herein is set forth in U.S. Pat. No. 6,746,371 to Brown et al., the disclosure of which is incorporated by reference herein in its entirety.

For example, FIG. 1 of the '821 Publication illustrates a block diagram of one embodiment of an environment 100 in which the present systems and methods may be implemented. In one configuration, an exercise apparatus 102 may exchange information with a client computing device 106. The client computing device 106 may acquire the information from the apparatus 102. For example, the information may be embedded as a data exchanging module 104 that is included on or by the exercise apparatus 102. Examples of the data exchanging module 104 may include, but are not limited to, barcodes, QR codes, RF tags, etc. The module 104 may be affixed or attached to an area of the apparatus 102 or an area that is not on the apparatus 102 (e.g., a wall close to the apparatus 102). The client computing device 106 may include a data sensing module 108 that is able to sense the data exchanging module 104. For example, the sensing module 108 may provide scanning capabilities that allows the device 106 to scan the data exchanging module 104 to obtain information about the apparatus 102. For example, the data exchanging module 104 may be a barcode and the data sensing module 108 may be a barcode scanner. In another embodiment, the data exchanging module 104 and the data sensing module 108 may include near field communication (NFC) capabilities. As a result, using NFC standards, a radio communication link may be established between the apparatus 102 and the device 106. The client computing device 106 may acquire the information from the exercise apparatus 102 via the radio communication link. The apparatus 102 and the device 106 may exchange information via other methods in addition to bar codes, QR codes, and NFC technologies.

Examples of the exercise apparatus 102 may include a weight machine (e.g., a fly machine, a leg press machine, a leg curl machine, a leg extension machine, a cable lateral pull-down machine, a triceps pull-down machine, a row machine, etc.). The exercise apparatus 102 may also be a free weight, such as a dumbbell, a medicine ball, an exercise ball, a bench press, etc. In another embodiment, the exercise apparatus 102 may be a cardio machine (e.g., a treadmill, a stationary bike, a spinner bike, a stair machine, etc.).

In one embodiment, the client computing device 106 may be a smartphone, a laptop, a tablet, or any other portable computing device. In one configuration, the client computing device 106 may be any device that is able to detect, receive, and interpret the data acquired from the data exchanging module 104. To interpret the received data, the client computing device 106 may communicate with a server 112 across a network 110 connection. The network 110 connection may be a Wi-Fi, a wireless local area network (WLAN), a cellular network, and the like. The server 112 may communicate with an exercise apparatus database 114. The database 114 may be external to the server 112, or the database 114 may be built into the server 112. In one embodiment, the exercise apparatus database 114 may store information regarding the exercise apparatus 102. For example, the database 114 may store instructions that indicate how to properly use the exercise apparatus 102. The database 114 may also store videos that demonstrate how to use the apparatus 102. In one example, the client computing device 106 may acquire information from the apparatus, such as an identifier that identifies the apparatus 102. The identifier may be communicated to the server 112. The server 112 may use the identifier to locate additional information in the database 114 about the apparatus 102. The server may communicate the additional information about the apparatus 102 to the computing device 106. In one embodiment, the data exchanging module 104 may include the additional information that is stored in the database 114. As a result, when the computing device 106 acquires the information from the apparatus 102, there may be no need for the client 106 to communicate with the server 112 to acquire the additional information.

FIG. 2 of the '821 Publication is a block diagram illustrating one embodiment of a client computing device 106-*a*. The client computing device 106-*a* may be an example of the client computing device 106 illustrated in FIG. 1 of the '821 Publication. In one example, the client computing device 106-*a* may include a data sensing module 108-*a*. In one configuration, the module 108-*a* may include a QR code module 202, a barcode reading module 204, an NFC module 206, a profile module 208, a customized workout module 210, and a tracking module 212. Details regarding each of these modules will be described below.

In one embodiment, the QR code module 202 may sense data affixed to or by the exercise apparatus 102 that is encoded as a QR code. Similarly, the barcode reading module 204 may sense data embedded or encoded as a barcode that may be attached to or near the exercise apparatus 102. The modules 202 and 204 may sense the data by scanning the QR code or the barcode that is attached to the exercise apparatus 102. The NFC module 206 may establish a radio communication link with the exercise apparatus 102. The NFC module 206 may acquire data from the exercise apparatus 102 via the radio communication link.

In one configuration, the profile module 208 may receive and store input from a user relating to the user's profile information. Examples of profile information may include the user's age, height, weight, etc. The profile module 208 may further receive and store input from the user relating to physical fitness goals of the user. Examples of physical fitness goals may include a desired weight loss, strength conditioning goals, target heart rate goals, running/walking distance goals, specific muscle definition goals etc. The customized workout module 210 may receive the data sensed from the modules, 202, 204, and/or 206. The workout module 210 may also receive information stored by the profile module 208. In one embodiment, the workout module 210 may generate a customized workout routine for the user to perform with the exercise apparatus 102 in order to progress towards achieving the physical fitness goals stored in the profile module.

As an example, the client computing device 106-*a* may receive data relating to the exercise apparatus 102. The data may indicate the name of the apparatus 102, the functions of the exercise apparatus 102, instructions on how to properly use the exercise apparatus 102, the muscle group focused on by the exercise apparatus 102, the health benefits of using the apparatus 102, video or other multimedia data that demonstrate how to use the apparatus 102, etc. The data may be received directly from the data exchange module 104 affixed to the apparatus 102 and/or from the server 112 that obtains the data from the database 114 and communicates the data to the client computing device 106. The customized workout module 210 may analyze the received data about the exercise apparatus 102 together with the information stored by the profile module 208. Based on this analysis, the customized workout module 210 may generate a workout routine for the user to perform with the exercise apparatus 102. The generated workout routine may be focused on helping the user accomplish one or more physical fitness goals stored by the profile module 208. For example, the user may specify a physical fitness goal of bench pressing 200 lbs. The profile module 208 may also include information that indicates that the user is currently able to bench 160 lbs. The user may then approach a chest fly machine with the client computing device 106-*a*. A barcode may be affixed on a portion of the machine. The computing device 106-*a* may scan the barcode and obtain data about the machine. As stated above, the data may be acquired from the scan of the barcode and/or from the server 112. For example, the client 106-*a* may scan the barcode and retrieve the identity of the machine (in this example, a chest fly machine). The identity may be transmitted to the server 112. The server 112 may use the received identity to search the database 114 for data about the machine. The server 112 may then communicate the data back to the client computing device 106-*a*.

The data (either obtained directly from the exercise apparatus 102 and/or from the server 112) may indicate that the chest fly machine focuses on certain chest muscles. The data may also include a video demonstration that illustrates how to properly use the chest fly machine. The customized workout module 210 may generate a workout routine (e.g., number of repetitions, sets, and the weight resistance) for the user to follow when using the chest fly machine. The routine may be generated based on an analysis of the information stored by the profile module 208 as well as the data acquired from the exercise apparatus (directly and/or indirectly from the server 112). The workout routine may be customized for the user to assist the user to accomplish the physical fitness goal(s) included in the profile module. As a result, the workout routine, if followed by the user, may assist the user to accomplish the goal of bench pressing 200 lbs.

In one example, the profile module 208 may not include physical fitness goal information that relates to a certain exercise apparatus 102. For instance, the sensing module 108-*a* may acquire information relating to a treadmill by scanning a barcode, QR code, etc. The customized workout module 210 may analyze the profile module 208 and discover that the user has not entered a goal that may be accomplished by using the treadmill. In one configuration, the customized module 210 may query the user as to whether the user would like to enter a physical fitness goal that may be achieved by using the treadmill. For example, the module 210 may display the following query "Do you want to set a goal to run 3 miles in 30 minutes?" If the user selects this goal, the workout module 210 may continue to generate a customized workout routine for the user to assist the user to complete this goal. Instead of selecting a goal generated by the customized workout module 210, the user may provide his/her own goal as it relates to the treadmill. Once the goal is provided, the module 210 may generate a customized workout routine.

The tracking module 212 may track the progress of the user while the user is using the exercise apparatus 102. For example, the tracking module 212 may be a camera or other tracking device that is capable of monitoring the movement of the user. The tracking module 212 may also track the progress of the user towards completing the goals specified in the profile module 208. For example, the profile module 208 may include a goal to lose 20 lbs. The tracking module 212 may track the weight of the user to allow the user to see his/her progress towards achieving the goal of losing 20 pounds. In one example, the user may manually enter his/her weight into the tracking module 212. In another embodiment, the tracking module 212 may track the progress of the user by receiving automatic updates via email, SMS messages, and the like that include the current state of the user. For example, the user may visit a web site and record his/her weight on the website. The website may communicate with the tracking module 212 to provide the updated weight of the user.

FIG. 3 of the '821 Publication is a block diagram illustrating one embodiment of a profile module 208-*a*. The profile module 208-*a* may be an example of the profile module 208 illustrated in FIG. 2 of the '821 Publication. In one configuration, the profile module 208-*a* may include a personal information module 302 and a goal information module 304.

In one embodiment, the personal information module 302 may include personal information about the user, such as, but not limited to, the user's age, height, weight, resting heart rate, and any other biometric information. The goal information module 304 may include physical fitness goals provided by the user. For example, the goal information module 304 may store a weight loss goal, a strength conditioning goal, a cardio goal, and the like. In one example, the user may manually input information to the modules 302, 304 via interfaces provided by the client computing device 106. In another embodiment, the user may provide the information to the modules 302, 304 remotely by interfacing with a website and inputting the information. The information may then be transmitted from the website to the client computing device 106 and stored as part of the modules 302, 304.

FIG. 4 of the '821 Publication is a block diagram illustrating one embodiment of a customized workout module 210-*a*. The module 210-*a* may be an example of the customized workout module 210 of FIG. 2 of the '821 Publication. In one embodiment, the module 210-*a* may include a profile analysis module 402, an exercise apparatus analysis module 404, a workout generation module 406, and a demonstration generation module 408.

In one configuration, the profile analysis module 402 may analyze information provided by the profile module 208. The information provided by the profile module 208 may include the physical fitness goals entered by the user. The workout generation module 404 may generate a customized workout routine for the user with relation to the exercise apparatus 102. For example, the exercise apparatus 102 may be a dumbbell. The profile analysis module 402 may determine that the user has set a goal to be able to do 10 repetitions of a bicep curl using a 50 pound dumbbell. The profile analysis module 402 may further determine from the information provided by the profile module 208 that the user has previously performed curls using 25 lb dumbbells. The exercise apparatus analysis module 404 may analyze data about the apparatus. The data may be received by scanning a barcode, QR code, etc. that may be affixed to the apparatus. The profile analysis module 402 may determine from the specific muscles focused on by the exercise apparatus.

The workout generation module 406 may generate a schedule of workouts for dumbbells of various weights that will gradually build up the user's bicep muscles to eventually reach the user's goal of performing 10 repetitions of a bicep curl using a 50 lb dumbbell. For example, the generation module 406 may suggest the user begin by performing 3 sets of 10 repetitions using 25 lb dumbbells. The generated workout may instruct the user to perform this workout four times a week. The generation module 406 may generate a workout that specifies that each week the weight of the dumbbell should be increased by 5 lbs. As a result, based on the goals provided by the user, the generation module 404 may generate a customized workout for a particular exercise apparatus 102 to assist the user to achieve his/her goals.

The demonstration generation module 408 may generate and/or provide a demonstration of how to use the exercise apparatus 102. For example, the generation module 408 may generate and/or provide a video that the user may view on the client computing device 106 to learn how to properly use the exercise apparatus 102. The demonstration generation module 408 may also generate and/or provide a text document that the user may read that includes instructions on how to use the exercise apparatus 102.

FIG. 5 of the '821 Publication is a block diagram illustrating one embodiment of an exercise apparatus 102-*a* and a tracking module 212-*a*. In one example, the exercise apparatus 102-*a* may be an example of the exercise apparatus 102 illustrated in FIG. 1 of the '821 Publication. The tracking module 212-*a* may be an example of the tracking module 212 illustrated in FIG. 2 of the '821 Publication.

In one embodiment, the exercise apparatus 102-*a* may include a monitoring apparatus 502-*a*-1. The monitoring apparatus 502-*a*-1 may monitor the user while the user is using the exercising apparatus 102-*a*. For example, the monitoring apparatus 502-*a*-1 may be a camera installed or connected to the exercise apparatus 102-*a*. The apparatus 502-*a*-1 may also be a magnetic strip attached to the exercise apparatus 102-*a* that detects movement of the apparatus 102 (e.g., a dumbbell). The monitoring apparatus 502-*a*-1 may record the actions of the user while the user is performing exercises using the exercising apparatus 102-*a*. The recorded actions may be transmitted to the tracking module 212-*a*.

The tracking module 212-*a* may also include a monitoring apparatus 502-*a*-2 to record the actions of the user while the user is engaged with a particular exercise apparatus. The apparatus 502-*a*-2 may be a camera, or other tracking device to record the activity of the user. The tracking module 212-*a* may further include a workout history module 504 and a goal monitoring module 506. The workout history module 504 may store information regarding past workouts performed by the user. For example, the monitoring apparatuses 502-*a*-1 and/or 502-*a*-2 may monitor a user running on a treadmill for 30 minutes. At the conclusion of the 30 minutes, the monitoring apparatus 502 may communicate the information to the workout history module 504. If the user is using a weight machine, the monitoring apparatus 502 may detect the number of repetitions as well as the weight used during the repetitions. As a result, the workout history module 504 may include a log that documents the past workout activity of the user with various exercise machines.

In one embodiment, the goal monitoring module 506 may monitor the goals specified by the user. The module 506 may track the progress of the user with respect to achieving the goals. For example, the goal monitoring module 506 may communicate with the workout history module 504 to determine whether the user has satisfied a particular goal. The monitoring module 506 may generate a transmit goal update message to the user (e.g., via email, SMS text, etc.) that indicate to the user the user's progress in completing a goal. The module 506 may also send a goal completed message to the user when it is determined that a physical fitness goal has been accomplished.

FIG. 9 of the '821 Publication depicts a block diagram of a computer system 910 suitable for implementing the present systems and methods. The computer system 910 may be an example of the client computing device 106 of FIG. 1 of the '821 Publication. Computer system 910 includes a bus 912 which interconnects major subsystems of computer system 910, such as a central processor 914, a system memory 917 (typically RAM, but which may also include ROM, flash RAM, or the like), an input/output controller 918, an external audio device, such as a speaker system 920 via an audio output interface 922, an external device, such as a display screen 924 via display adapter 926, serial ports 928 and 930, a keyboard 932 (interfaced with a keyboard controller 933), multiple USB devices 992 (interfaced with a USB controller 991), a storage interface 934, a floppy disk unit 937 operative to receive a floppy disk 938, a host bus adapter (HBA) interface card 935A operative to connect with a Fibre Channel network 990, a host bus adapter (HBA) interface card 935B operative to connect to a SCSI bus 939, and an optical disk drive 940 operative to receive an optical disk 942. Also included are a mouse 946 (or other point-and-click device, coupled to bus 912 via serial port 928), a modem 947 (coupled to bus 912 via serial port 930), and a network interface 948 (coupled directly to bus 912).

Bus 912 allows data communication between central processor 914 and system memory 917, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, the data sensing module 108-*b* to implement the present systems and methods may be stored within the system memory 917. Applications resident with computer system 910 are generally stored on and accessed via a non-transitory computer readable medium, such as a hard disk drive (e.g., fixed disk 944), an optical drive (e.g., optical drive 940), a floppy disk unit 937, or other storage medium. Additionally, applications can be in the form of electronic signals modulated in accordance with the application and data communication technology when accessed via network modem 947 or interface 948.

In one configuration, when the portable device retrieves information about an exercise machine, the portable device may also access physical fitness goals for the user. The user may have previously entered the goals or, upon retrieving information about an exercise machine, the portable device may query the user to select or enter physical fitness goals. Upon accessing the goals, the information about the exercise machine may be analyzed to determine whether the exercise machine may assist the user to accomplish one or more of the goals. If the machine cannot help the user accomplish the provided goals, the user may be queried as to whether he/she would like to select (or provide) a goal that this particular exercise machine may help the user accomplish. If the machine is able to assist the user in completing a goal, a customized workout routine may be generated and displayed to the user. The workout routine may provide instructions to the user relating to the number of repetitions, sets, the amount of weight, the amount of time, speed, incline, resistance, etc., that the user should perform to accomplish a goal using the exercise machine.

The invention claimed is:

1. A strength training apparatus comprising:
- a tower;
- a first arm and a second arm each pivotally coupled with the tower and each being configured to be selectively positionable independent of each other at multiple angles relative to each other;
- a first pulley coupled to an end of the first arm;
- a first cable extending through the first arm and the first pulley;
- a second pulley coupled to an end of the second arm;
- a second cable extending through the second arm and the second pulley;
- a magnetic mechanism coupled to the first cable and the second cable and configured to provide multiple levels of resistance to a user pulling on the first cable and/or the second cable; and
- a control panel located on the tower, wherein the control panel includes a processor and a memory, wherein the processor is configured to:
  - receive a workout routine including a level of resistance and a number of repetitions;
  - control a current level of resistance provided by the magnetic mechanism according to the level of resistance of the workout routine;
  - count a number of repetitions performed by a user; and
  - determine that the user has performed a number of repetitions equal to the number of repetitions of the workout routine.

2. The strength training apparatus of claim 1, further comprising:
- a first handle coupled to the first cable; and
- a second handle coupled to the second cable.

3. The strength training apparatus of claim 1, further comprising a display, wherein the display is configured to display the current level of resistance, the number of repetitions performed by the user, and the number of repetitions of the workout routine.

4. The strength training apparatus of claim 1, wherein the control panel is further configured to receive and store a physical fitness goal that is inputted by the user.

5. The strength training apparatus of claim 4, wherein the control panel is further configured to generate the customized workout routine for the strength training apparatus based on the stored physical fitness goal.

6. The strength training apparatus of claim 4, wherein the control panel is further configured to generate a schedule of upcoming customized workout routines for the strength training apparatus based on the stored physical fitness goal.

7. The strength training apparatus of claim 4, wherein the control panel is further configured to track progress of the user toward completing the stored physical fitness goal.

8. The strength training apparatus of claim 4, wherein the control panel is further configured to display a progress of the user toward completing the stored physical fitness goal.

9. The strength training apparatus of claim 4, wherein the control panel is further configured to display that the user has achieved the stored physical fitness goal when it is determined that the stored physical fitness goal has been achieved.

10. The strength training apparatus of claim 1, wherein the control panel is further configured to store information regarding past workout routines performed by the user on the strength training apparatus.

11. A strength training apparatus comprising:

a tower;

a first arm and a second arm each pivotally coupled with the tower and each being configured to be selectively positionable independent of each other at multiple angles relative to each other;

a first pulley coupled to an end of the first arm;

a first cable extending through the first arm and the first pulley;

a second pulley coupled to an end of the second arm;

a second cable extending through the second arm and the second pulley;

a magnetic mechanism coupled to the first cable and the second cable and configured to provide multiple levels of resistance to a user pulling on the first cable and/or the second cable; and a control panel located on the tower, wherein the control panel includes a processor, a memory, and an electronic output device, wherein the processor is configured to:

receive a workout routine including a level of resistance;

control a current level of resistance provided by the magnetic mechanism according to the level of resistance of the workout routine; and display the current level of resistance on the electronic output device.

12. The strength training apparatus of claim 11, further comprising:

a first handle coupled to the first cable; and a second handle coupled to the second cable.

13. The strength training apparatus of claim 11, further comprising a display, wherein the processor and the memory are further configured to calculate an amount of power expended within a period of time by the user pulling on the first cable and/or the second cable.

14. The strength training apparatus of claim 11, wherein the control panel is further configured to receive and store a physical fitness goal that is inputted by the user.

15. The strength training apparatus of claim 14, wherein the control panel is further configured to generate the customized workout routine for the strength training apparatus based on the stored physical fitness goal.

16. The strength training apparatus of claim 14, wherein the control panel is further configured to generate a schedule of upcoming customized workout routines for the strength training apparatus based on the stored physical fitness goal.

17. The strength training apparatus of claim 14, wherein the control panel is further configured to track progress of the user toward completing the stored physical fitness goal.

18. The strength training apparatus of claim 14, wherein the control panel is further configured to display a progress of the user toward completing the stored physical fitness goal.

19. The strength training apparatus of claim 14, wherein the control panel is further configured to display that the user has achieved the stored physical fitness goal when it is determined that the stored physical fitness goal has been achieved.

20. The strength training apparatus of claim 11, wherein the control panel is further configured to store information regarding past workout routines performed by the user on the strength training apparatus.

* * * * *